US006810631B2

(12) United States Patent
Kraft

(10) Patent No.: US 6,810,631 B2
(45) Date of Patent: Nov. 2, 2004

(54) POOL DECK DRAIN AND SAFETY FENCE SUPPORT STRUCTURE

(76) Inventor: Robert J. Kraft, 1470 SW. Dyer Point Rd., Palm City, FL (US) 34990

( * ) Notice: Subject to any disclaimer, the term of this patent is extended or adjusted under 35 U.S.C. 154(b) by 43 days.

(21) Appl. No.: 10/302,200

(22) Filed: Nov. 22, 2002

(65) Prior Publication Data

US 2004/0098936 A1 May 27, 2004

(51) Int. Cl.[7] ..... F02B 5/00

(52) U.S. Cl. ..... 52/298; 52/296; 52/302.3; 52/302.5

(58) Field of Search ..... 52/298, 296, 302.3, 52/302.5, 302.7, 16; 405/41, 119, 43

(56) References Cited

U.S. PATENT DOCUMENTS 2,210,441 A * 8/1940 Bachman ..... 52/297
4,490,067 A * 12/1984 Dahowski ..... 404/4
4,815,888 A 3/1989 Stegmeier
5,090,165 A * 2/1992 Kenny ..... 52/165
5,161,784 A * 11/1992 Sader ..... 256/24
5,340,234 A * 8/1994 Rossi et al. ..... 405/48
5,529,436 A * 6/1996 Meyers ..... 405/119
5,553,833 A 9/1996 Bohen
5,664,769 A 9/1997 Sadinsky et al.
6,123,321 A 9/2000 Miller
6,125,593 A * 10/2000 Randolph et al. ..... 52/16
6,612,780 B2 * 9/2003 Dahowski et al. ..... 405/118

* cited by examiner

*Primary Examiner*—Carl D. Friedman
*Assistant Examiner*—Basil Katcheves
(74) *Attorney, Agent, or Firm*—Brian E. Mack

(57) ABSTRACT

A novel pool deck structure channel located beneath a swimming pool deck surface is disclosed that incorporates both a drainage device and a pool safety fence support structure. The unique channel design eliminate the need to have separate support holes drilled in a pool deck surface that can be a safety hazard when not in use, cause functional problems due to dirt and debris, and are not otherwise aesthetically pleasing. The unique channel design includes an elongated trough extending beneath the pool deck surface for supporting a drainage device, a plurality of holes in the trough, and a plurality of inserts within the holes that extend into the trough in order to support pool safety fence support posts.

16 Claims, 7 Drawing Sheets

POOL DECK DRAIN AND SAFETY FENCE SUPPORT STRUCTURE

BACKGROUND OF THE INVENTION

1. Field of the Invention

This invention relates to the field of art pertaining to drainage systems for pools and more specifically to a pool deck structure that provides for co-location of a drainage device and safety fence support system.

2. Description of Related Art

Swimming pools, especially those built in-ground, are known to have large deck structures, typically made of concrete, surrounding the swimming pool. These deck structures are usually pitched in a direction away from the swimming pool in order to direct pool water run-off and rain run-off away from the swimming pool and towards a drainage device located about or within the pool deck structure. Examples of these type drainage devices are disclosed in U.S. Pat. Nos. 4,815,888, 5,454,663, 4,490,067, and 3,876,322. Advancements have been made regarding these drainage devices including changing the material for these drainage devices to polyvinylchloride (PVC) and incorporating a replaceable cover for easier maintenance.

Another feature of many swimming pools, especially those built in-ground, are pool safety fences that are erected from a pool deck structure, in close proximity to a swimming pool, and surround the perimeter of a swimming pool to prevent unwanted entry. In many regions, local governments have enacted legislation requiring swimming pool owners to have a pool safety fence in place when a swimming pool is not in use, to prevent entry by unsupervised children that could otherwise drown. Prior art safety fences have a plurality of poles that are typically supported by a plurality of holes, which are drilled in the pool deck surface. These extra holes are not only unsightly when not in use supporting safety fence poles, but are a safety hazard for pool users to trip over when moving about the pool deck structure.

Furthermore, these holes easily fill with dirt or debris making it difficult to insert the safety fence poles. The pool fence is typically close to the swimming pool and the drain device further away, due to the grading of the deck. Therefore, the holes in the pool deck structure for supporting the pool fence are typically covered when not in use to prevent possible injury.

The present invention seeks to overcome the shortfalls of the prior art by providing pool deck structure with a channel design extending beneath the pool deck surface that incorporates both a drainage device and a pool safety fence support structure. This improved pool deck structure design will eliminate the occurrence of unsightly and dangerously positioned exposed pool safety fence support holes in the pool deck structure.

SUMMARY AND OBJECTS OF THE INVENTION

The present invention relates to a novel pool deck structure channel located beneath a pool deck surface that is designed to accommodate both a drainage device and a pool safety fence support structure. The present invention incorporates multiple embodiments having different channel geometries. The pool safety fence support system includes a plurality of holes drilled in the pool deck structure beneath the channel and inserts placed in the holes and extending into the channel to provide additional structural support for the safety fence poles. Safety fence poles are inserted through holes in the pool drain cover and inserted into holes in inserts of the pool safety fence support structure.

It is an object of the present invention to provide a common location about a swimming pool for a drainage device and pool safety fence support system.

It is a further object of the present invention to eliminate additional holes in a pool deck structure that can be unsightly and a potential safety hazard.

In accordance with these and other objects, which will become apparent hereinafter, the instant invention will now be described with particular reference to the accompanying drawings.

DETAILED DESCRIPTION OF THE PREFERRED EMBODIMENT

Figure 1:
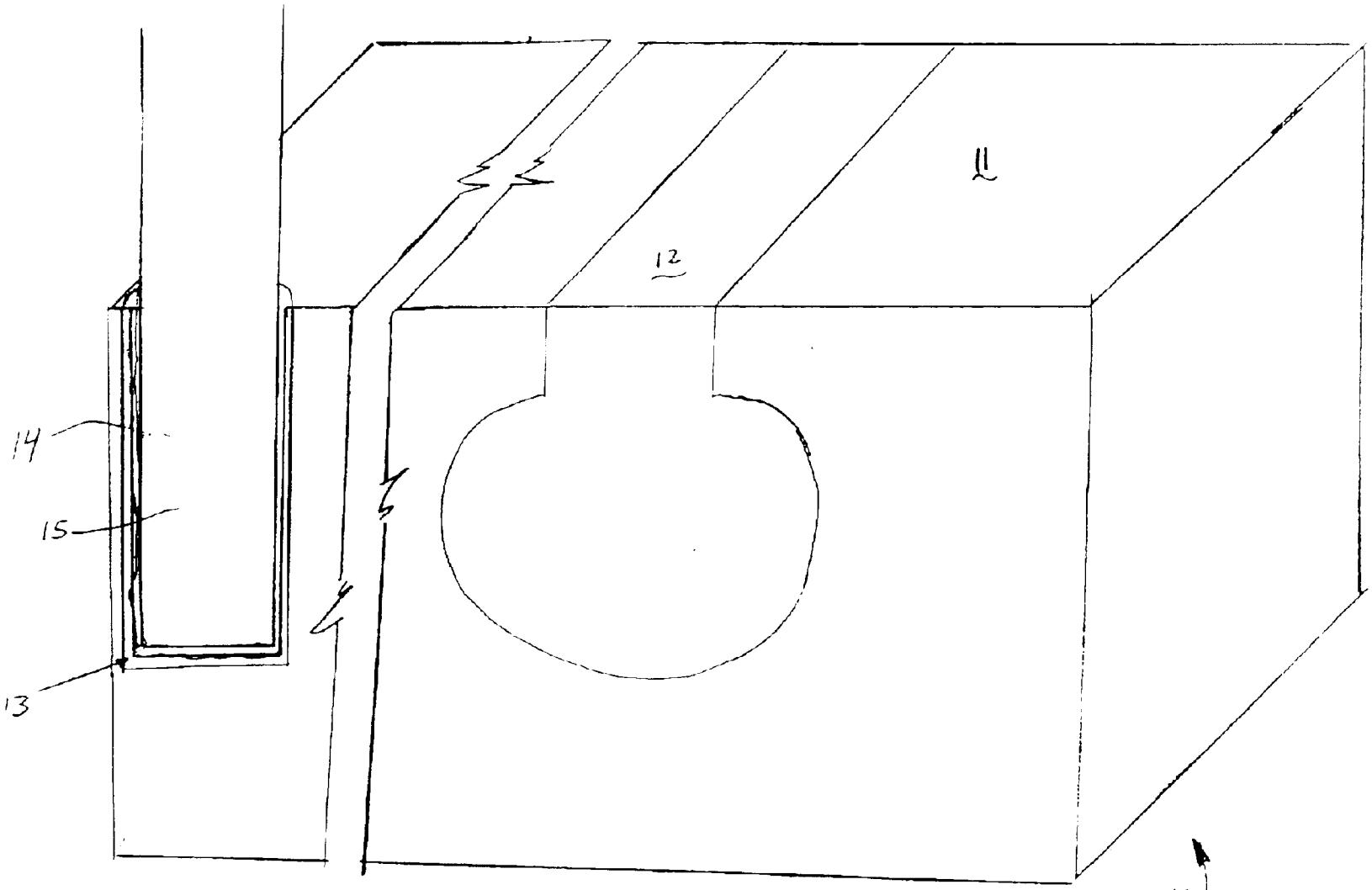
FIG. 1 PRIOR ART
FIG. 1 is a perspective view of a pool deck structure of the prior art.

Referring to FIG. 1, a pool deck structure of the prior art is shown in perspective view. It should be noted that the attached figures are merely representations and not necessarily to scale. Items may have been removed for clarity purposes. Pool deck structure 10 has a deck surface 11 and a drainage device 12. Also in pool deck surface 11 is a pool safety fence support structure 13 drilled into said pool deck structure 10 a distance away from a swimming pool and a distance away from drainage device 12. Under this arrangement, safety fence support structure 13 requires additional holes 14 to be drilled in pool deck structure 10 to support safety fence poles 15. Holes 14, when not supporting fence poles 15, can be a safety hazard causing a person to trip over the holes. They are also not aesthetically pleasing when fence poles 15 are removed, leaving open holes in an otherwise clear pool deck structure that can easily trap dirt and debris causing problems when inserting fence poles 15.

The present invention is shown in what is considered the preferred embodiment in FIGS. 2–5. A deck structure 20 for use about a swimming pool has a deck surface 21 and a channel 22 extending beneath deck surface 21. In the present invention, channel 22 provides a means for co-locating a drainage device and a safety fence support system. In the preferred embodiment, as shown specifically in FIGS. 2 and 3, channel 22 comprises a trough 23 having a generally elongated C-shape cross-section with a first end 24, second end 25, and a generally curved body 26 extending therebetween. It is to be understood that generally curved body 26 can have flat regions as well, depending on the drainage requirements. Extending from first end 24 is first sidewall 27 and extending from second end 25 is second sidewall 28. First sidewall 27 and second sidewall 28 are generally parallel to each other and extend towards deck surface 21 such that they are perpendicular to deck surface 21.

Figure 3:
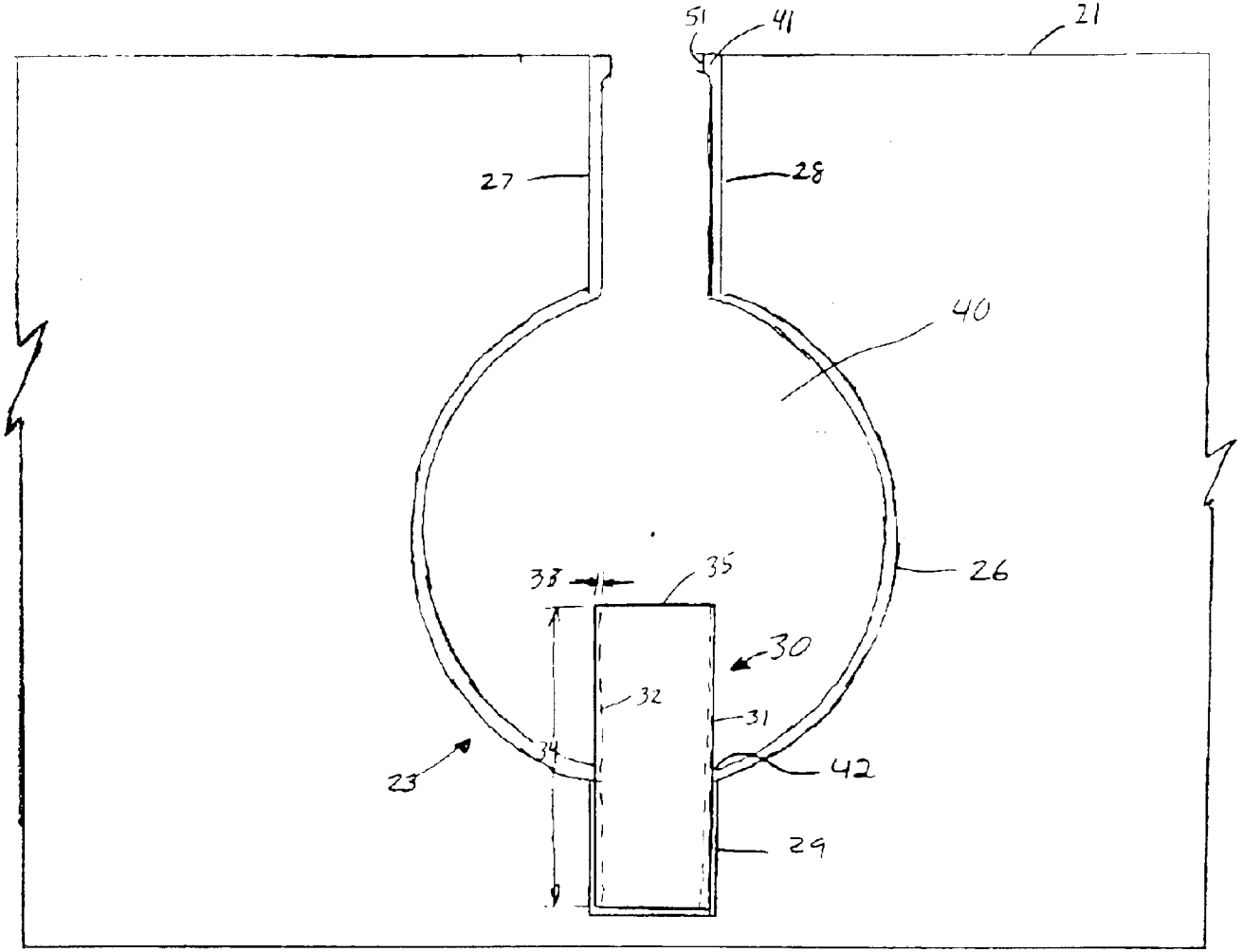
FIG. 3 is a cross section view of the preferred embodiment of the present invention shown incorporating a drainage system and pool safety fence.
Figure 4:
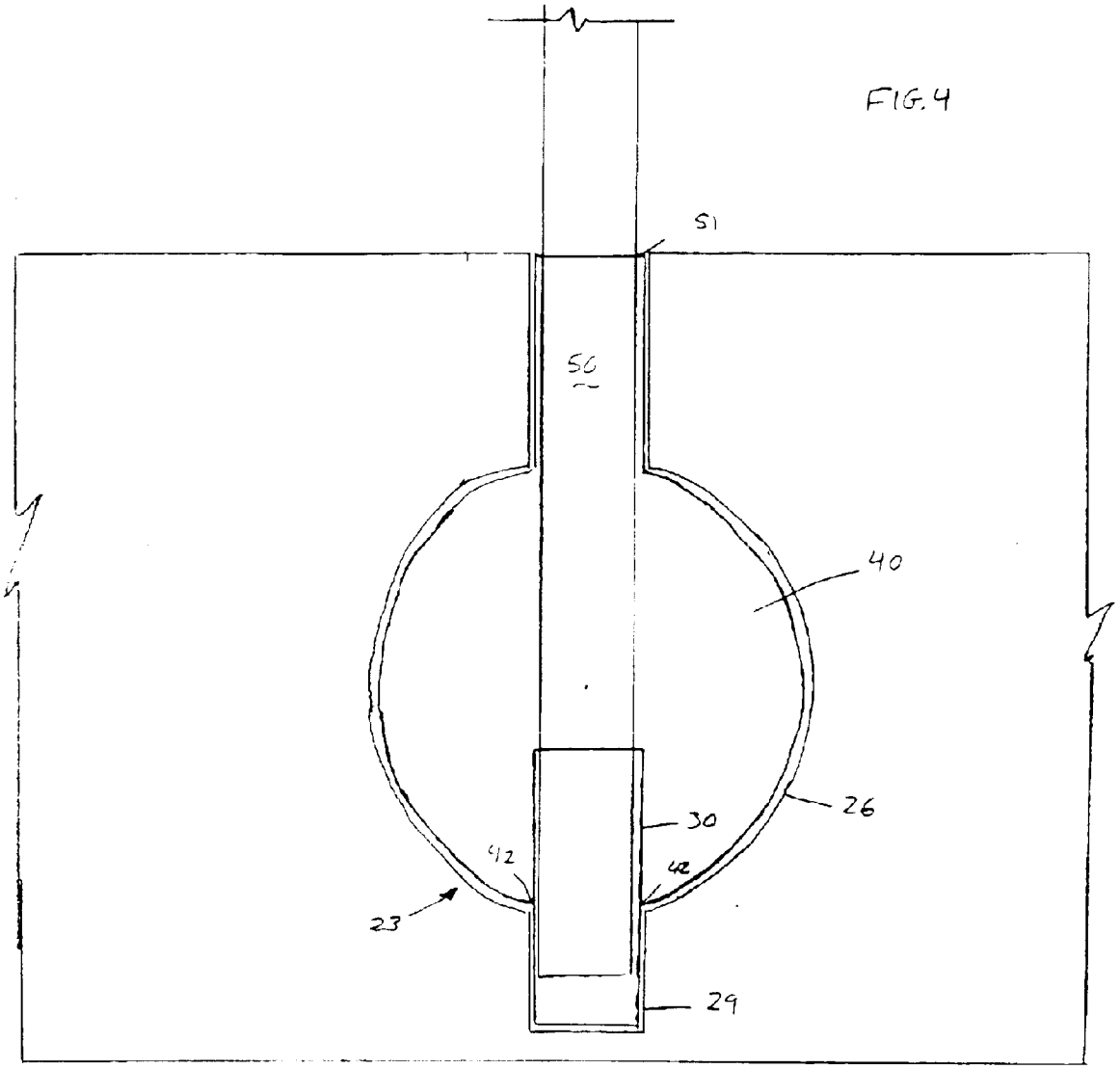
FIG. 4 is a cross section view of the preferred embodiment of the present invention.
Figure 5:
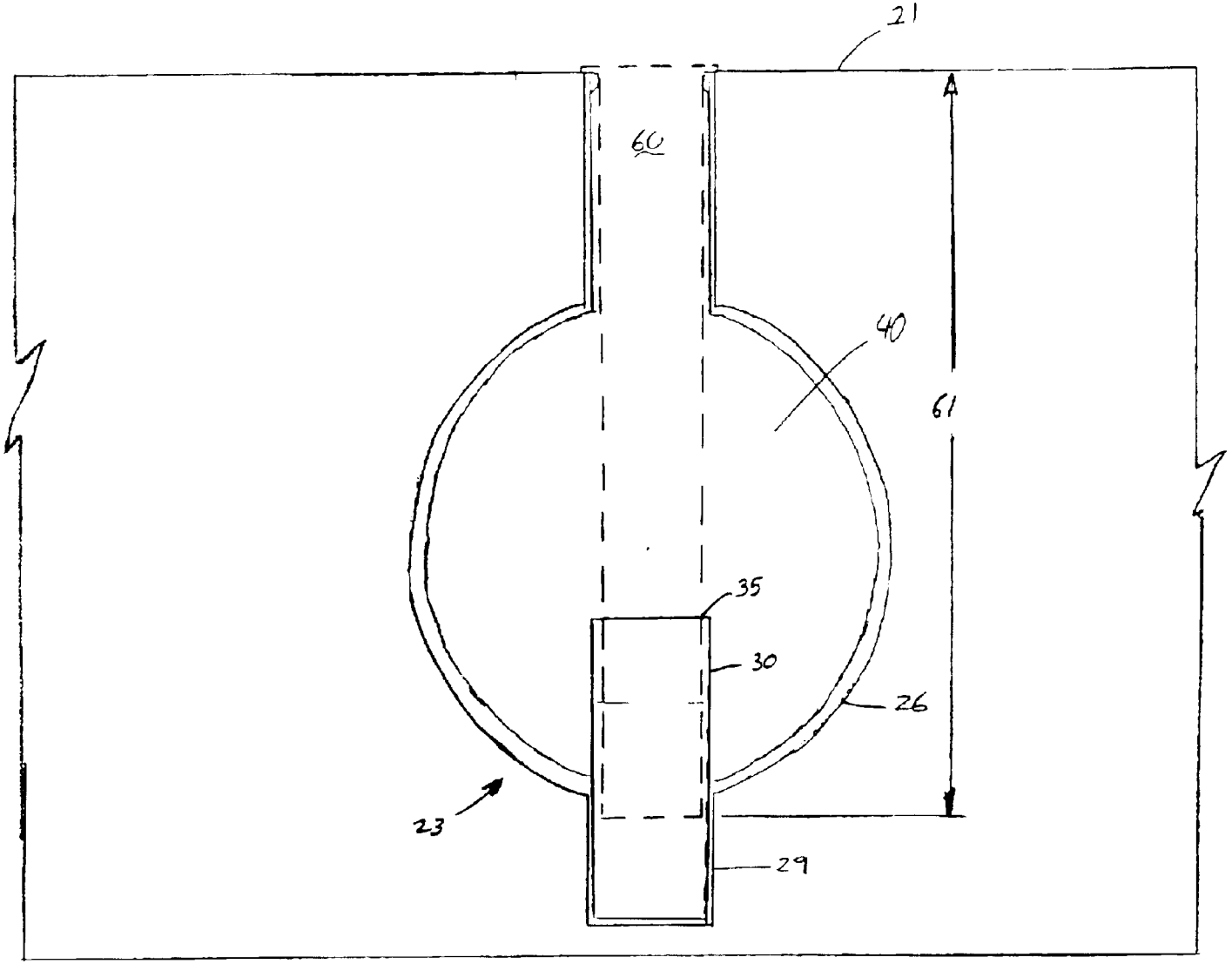
FIG. 5 is a cross section view of the preferred embodiment of the present invention incorporating cover plugs.

Channel 22 further comprises a plurality of first holes 29, as shown in FIGS. 3–5, located in generally curved body 26 of trough 23 extending in a direction perpendicular to deck surface 21. First holes 29, which extend beneath trough 23, are spaced apart along pool deck surface 21 at a predetermined interval necessary to provide adequate support to a pool safety fence. Referring to FIG. 3, channel 22 further contains a plurality of inserts 30, which are each positioned within first hole 29. Inserts 30 have an outer wall 31, inner wall 32, a thickness 33 there between of at least 0.030 inches, a first length 34, and a second hole 35 formed by inner wall 32. Outer wall 31 has dimensions such that insert 30 can be placed in first hole 29 thereby allowing insert 30 to extend from first hole 29 into trough 23 a distance sufficient to provide adequate support to a safety fence support pole. In order to reduce manufacturing costs and extend durability, inserts 30 are typically manufactured from a polymer plastic composition such as polyvinylchloride, also known more commonly as PVC. In the preferred embodiment, first holes 29, inserts 30, and second holes 35 each have a generally circular cross section, although one skilled in the art would understand that the cross sectional shape is independent of the function and therefore first and second holes and inserts could be of any corresponding cross section, such as rectangular.

Figure 2:
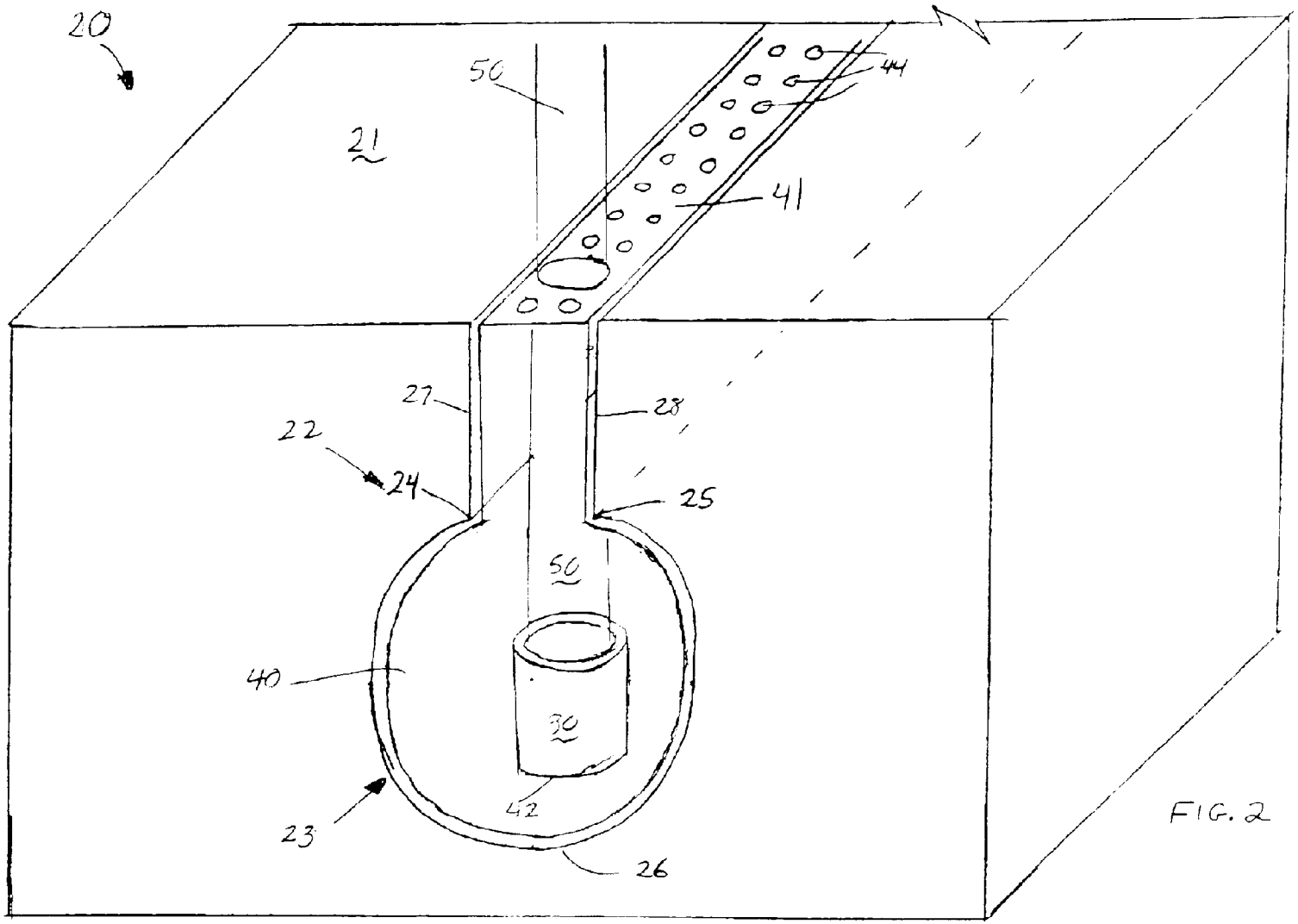
FIG. 2 is a perspective view of the preferred embodiment of the present invention shown incorporating a drainage system and pool safety fence.

Referring back to FIG. 2, channel 22 is configured to contain a drainage device 40 having a cross section similar to that of trough 23 wherein drainage device 40 can be fixed within channel 22 along trough 23 in order to transfer water from pool deck surface 21 to a point away from deck surface 21. As with inserts 30, most drainage devices 40 are manufactured from PVC and can contain either an integral or separable cover 41 having a plurality of drainage apertures 44 for transferring water from deck surface 21 to drainage device 40. In the preferred embodiment, drainage apertures 44 are round in shape, but one skilled in the art would understand that alternate configurations such as elongated slots may be used as well. Inserts 30, while considered a separate structural element in the preferred embodiment of the present invention, are sealed to drainage device 40 along joints 42 to prevent drainage water from leaking into trough 23 of channel 22. Depending on the manufacturing and assembly techniques utilized, inserts 30 can be integral to drainage device 40, such that joint 42 is eliminated. Referring now to FIGS. 3 and 4, inserts 30 have second holes 35 in order to support a safety pool fence pole 50, such that pole 50 is inserted into second hole 35 of insert 30. Referring to FIGS. 2–4, safety pool fence pole 50 extends from insert 30 through a third hole 51 in cover 41 to a sufficient height above pool deck surface 21 in order to support a fence material such as a nylon netting interconnected by a plurality of poles 50 to provide a barrier against unwanted access to a swimming pool. When a safety pool fence is not in use and poles 50 are removed from inserts 30, third holes 51 can serve as additional drainage apertures 44 in cover 41. Should third hole 51 be too large or unnecessary, a cover plugs 60, as shown in FIG. 5, having a second length 61 extends from deck surface 21 to proximate first hole 29, such that a plug 60 is placed within a second hole 35 of insert 30. In such an arrangement, second length 61 of cover plug 60 is greater than first length 34 of insert 30.

Figure 6:
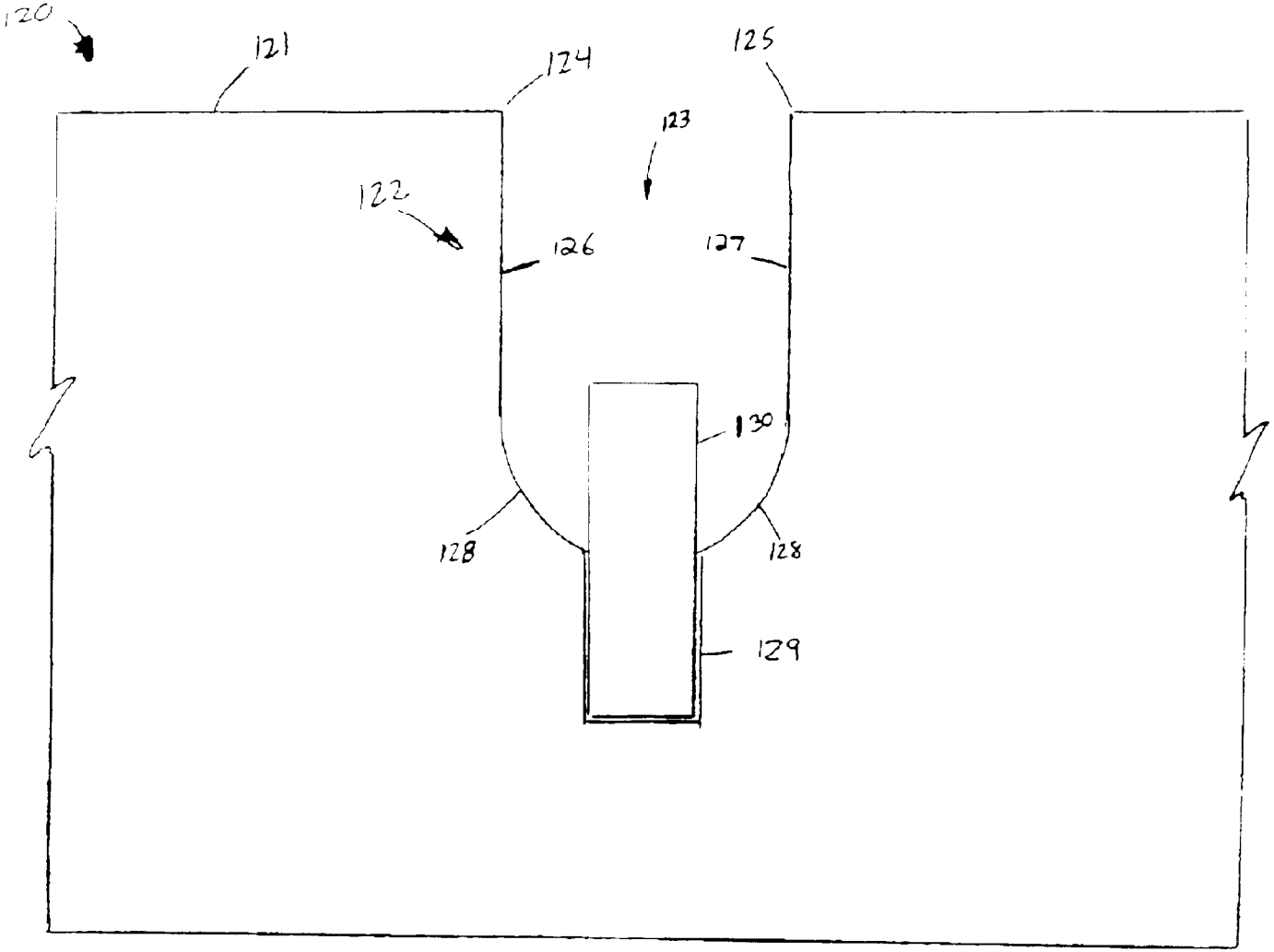
FIG. 6 is a cross section view of an alternate embodiment of the present invention incorporating a U-shaped channel cross section.
Figure 7:
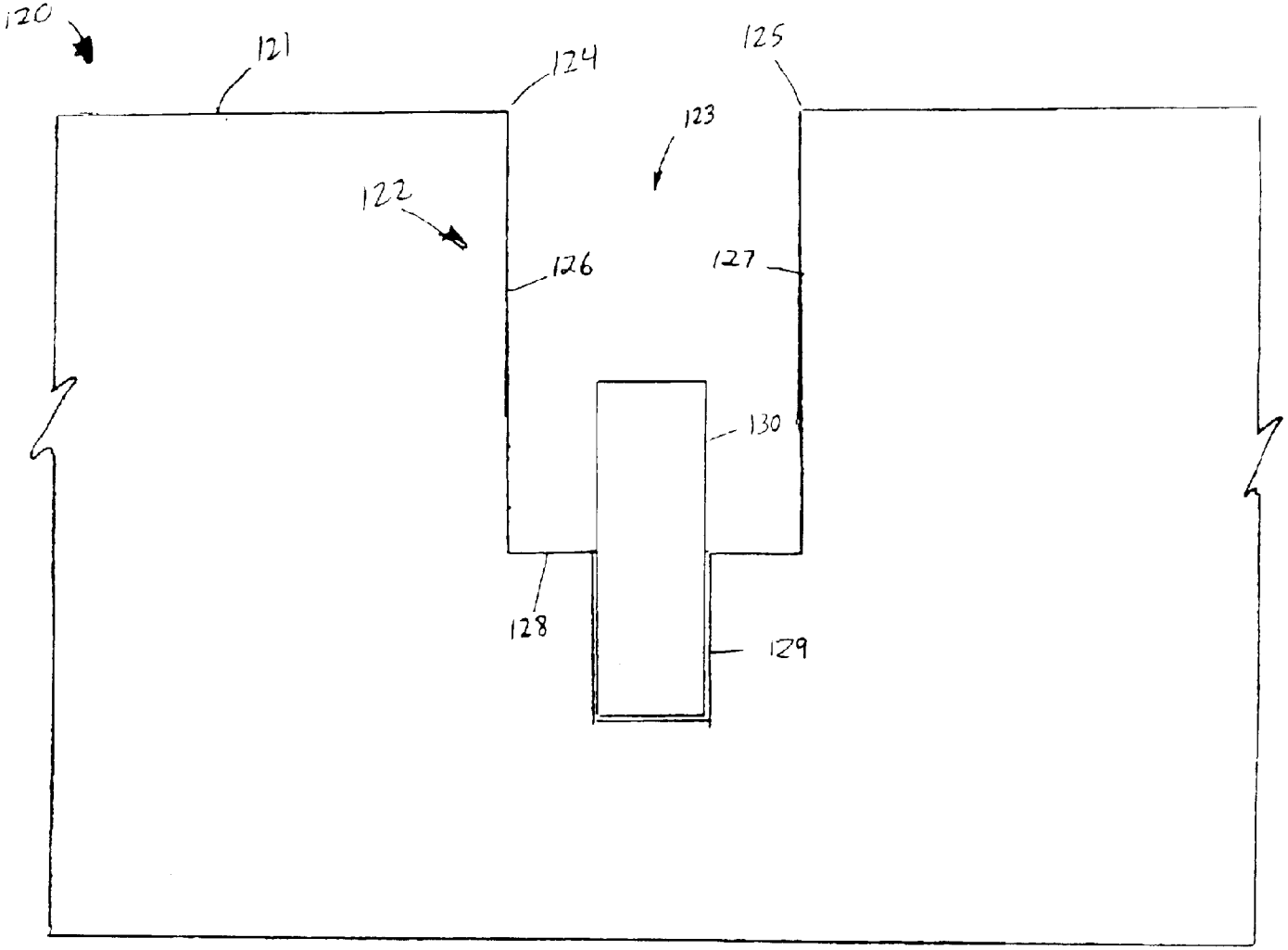
FIG. 7 is a cross section view of an alternate embodiment of the present invention incorporating an alternate U-shaped channel cross section.
Figure 1:
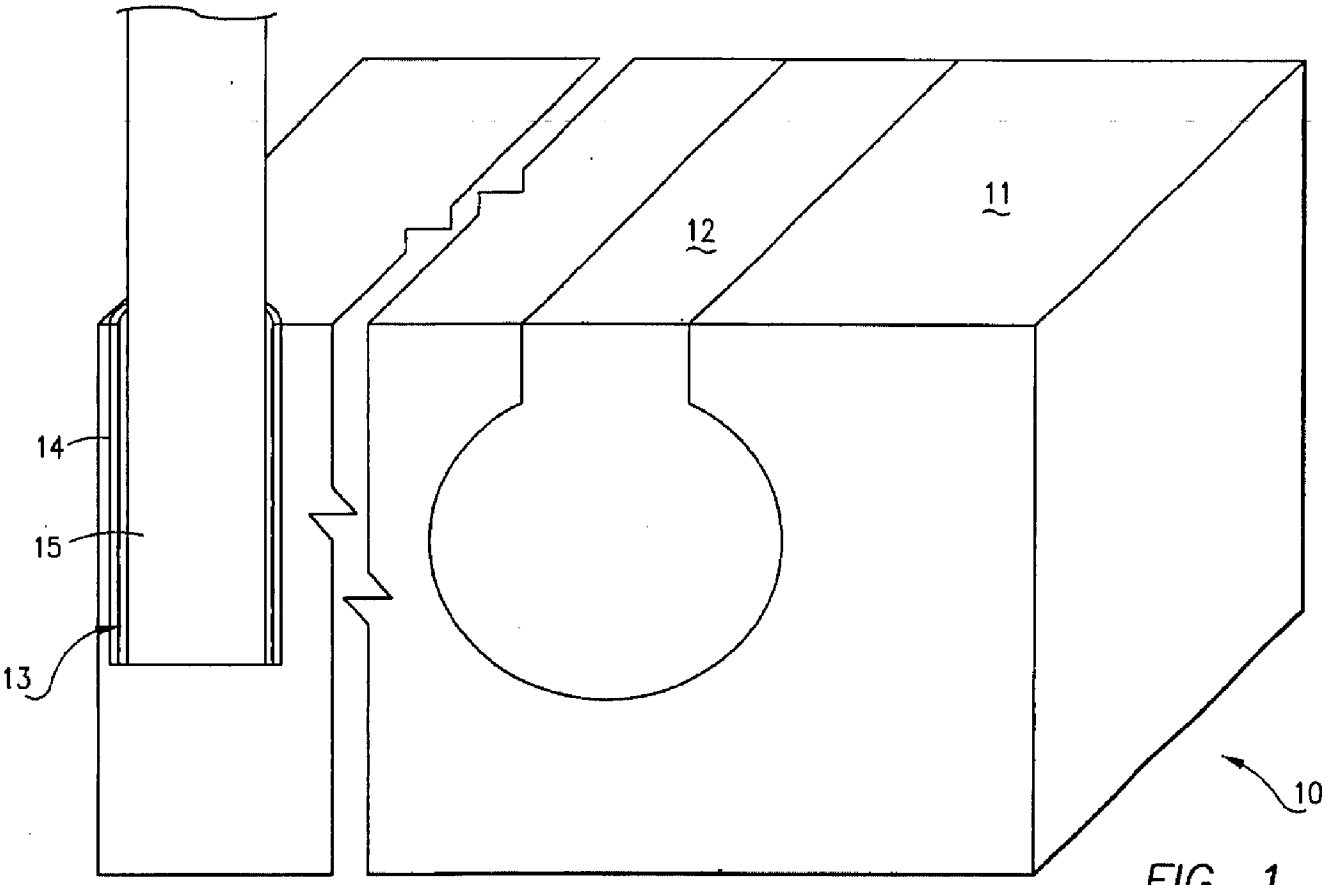
FIG. 1 PRIOR ART
Figure 2:
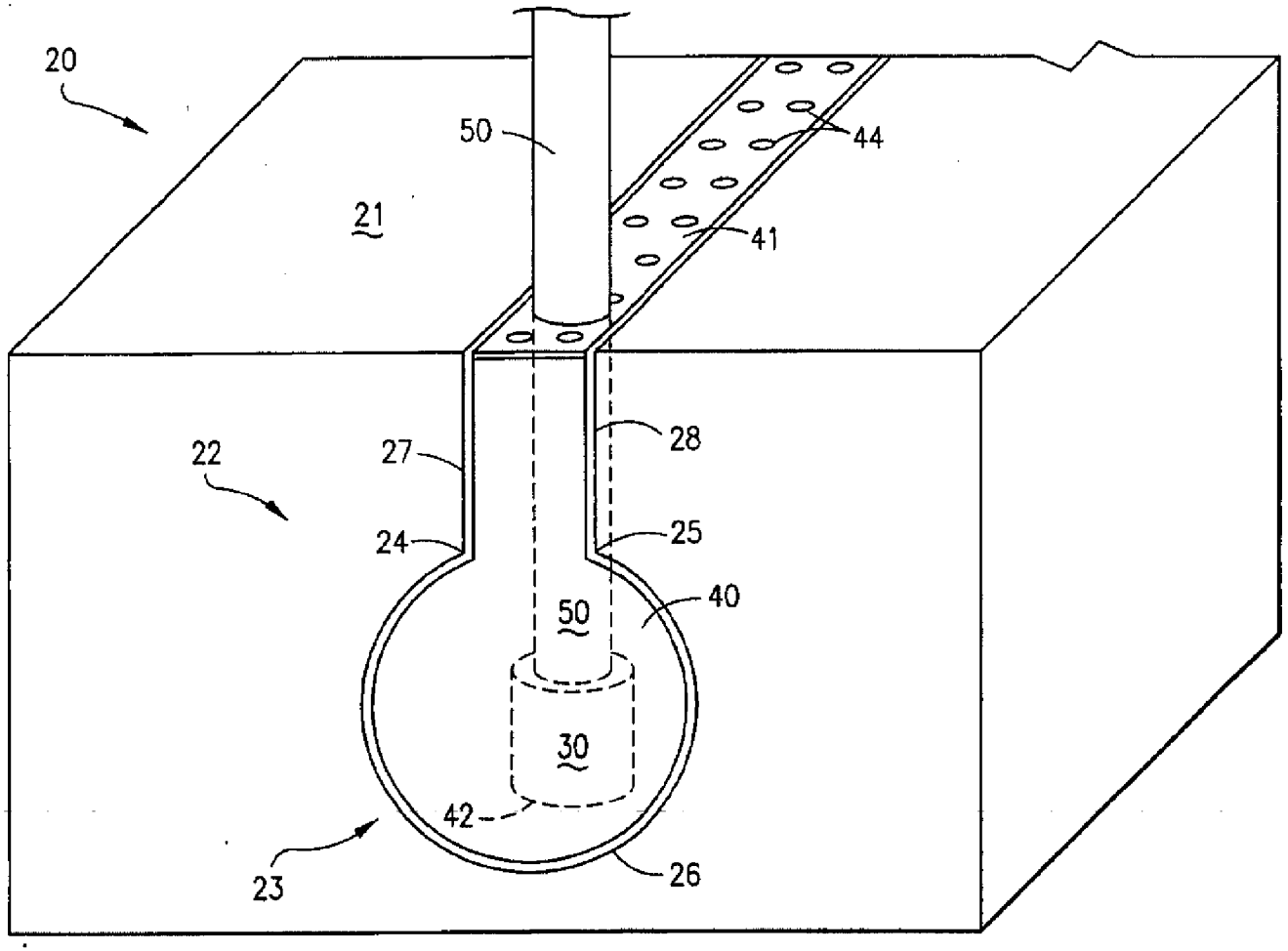
Figure 3:
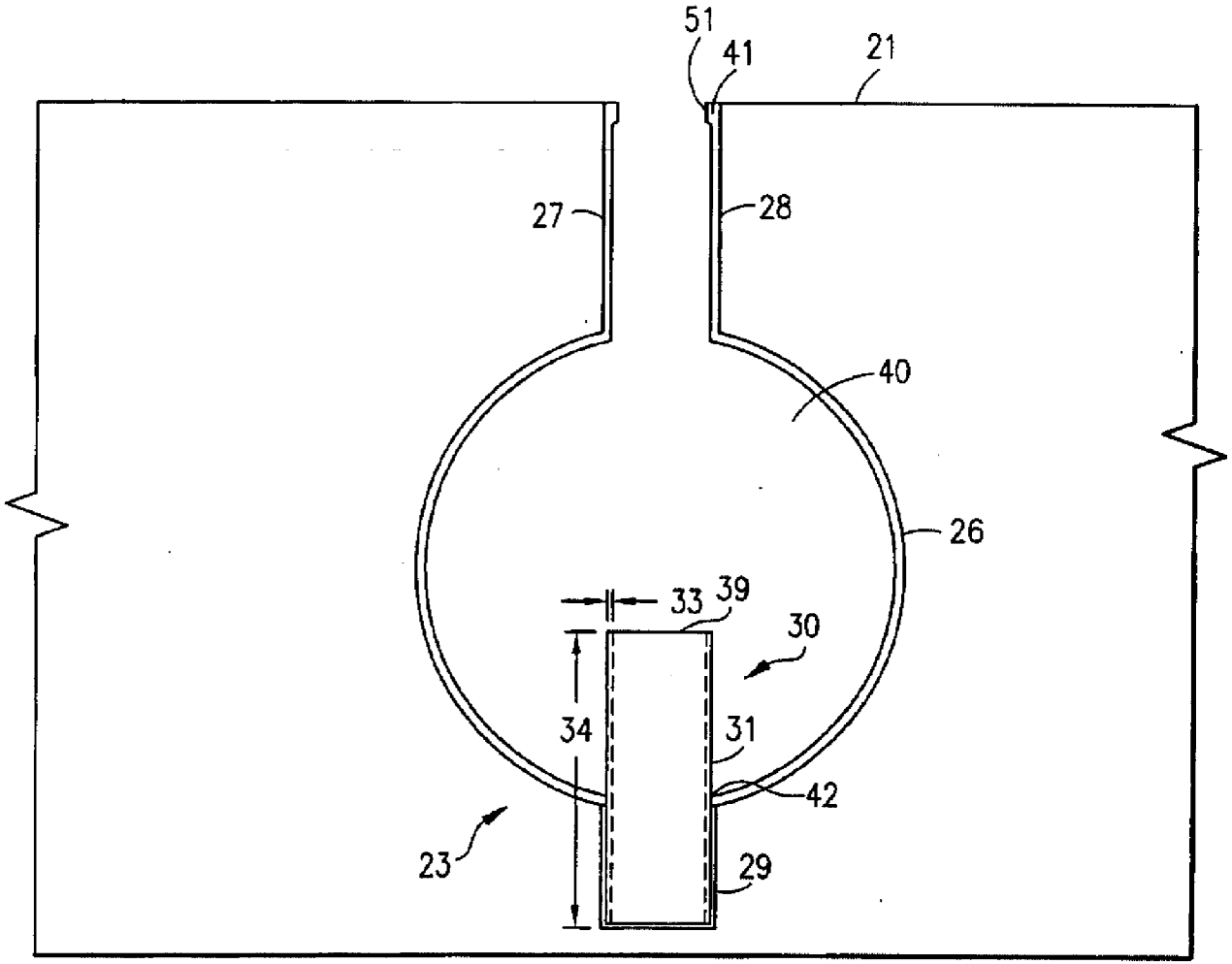
Figure 4:
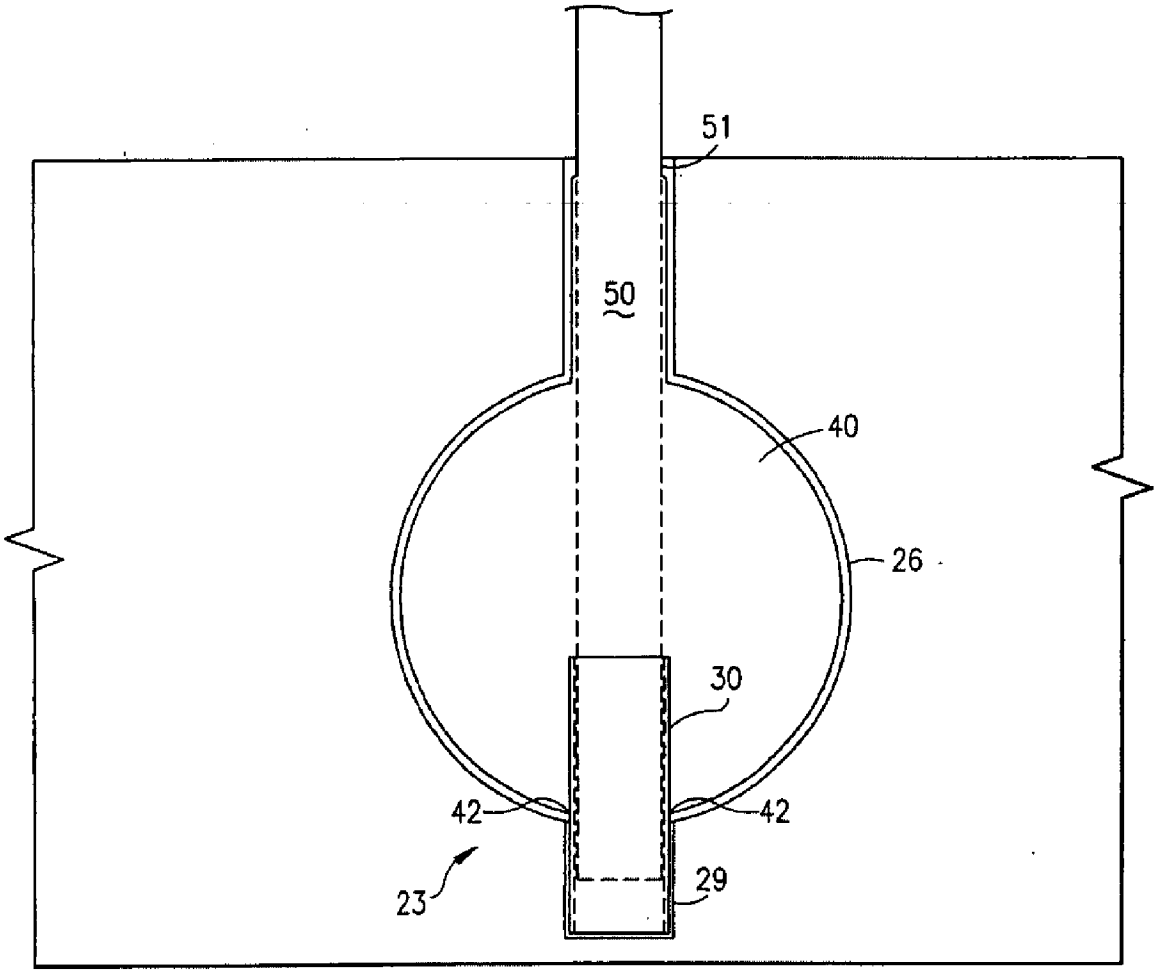
Figure 5:
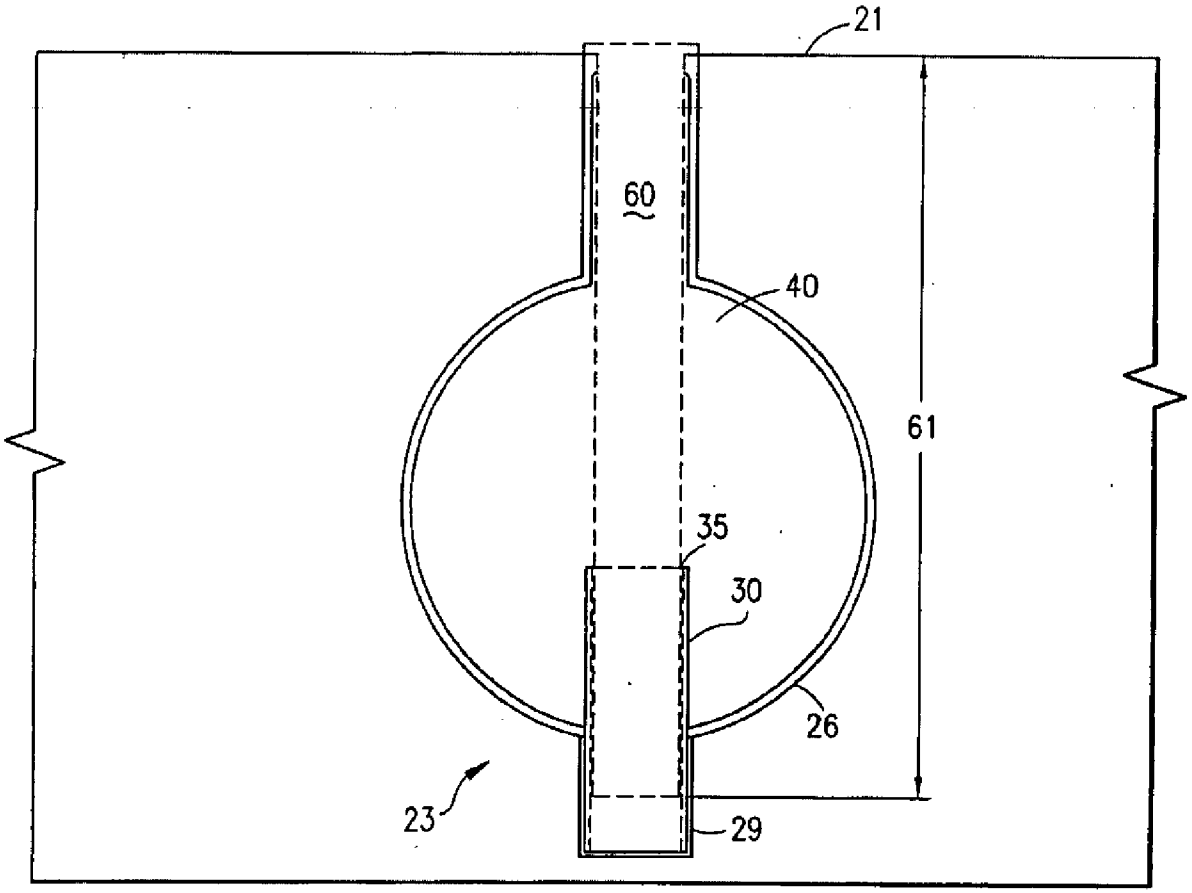
Figure 6:
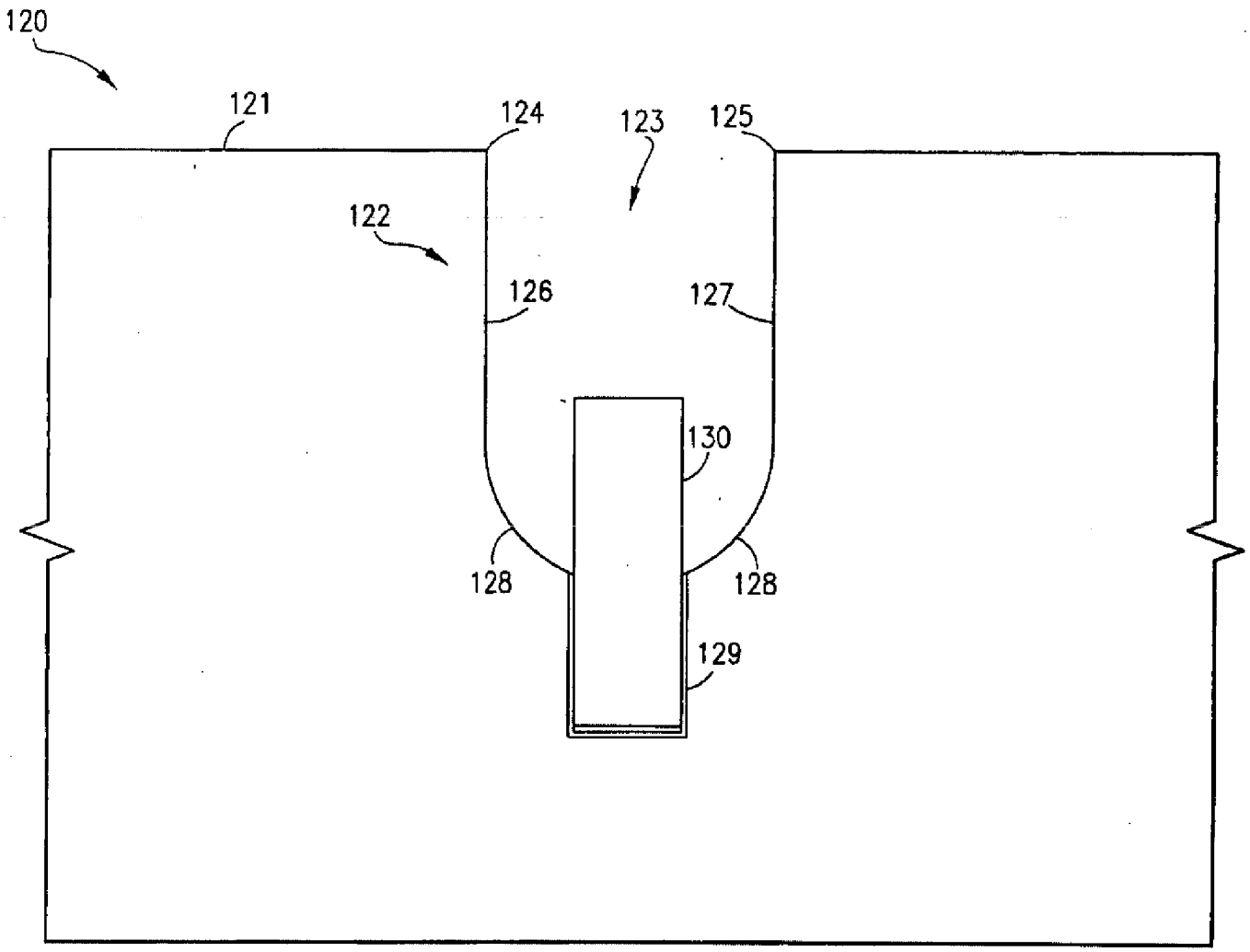
Figure 7:
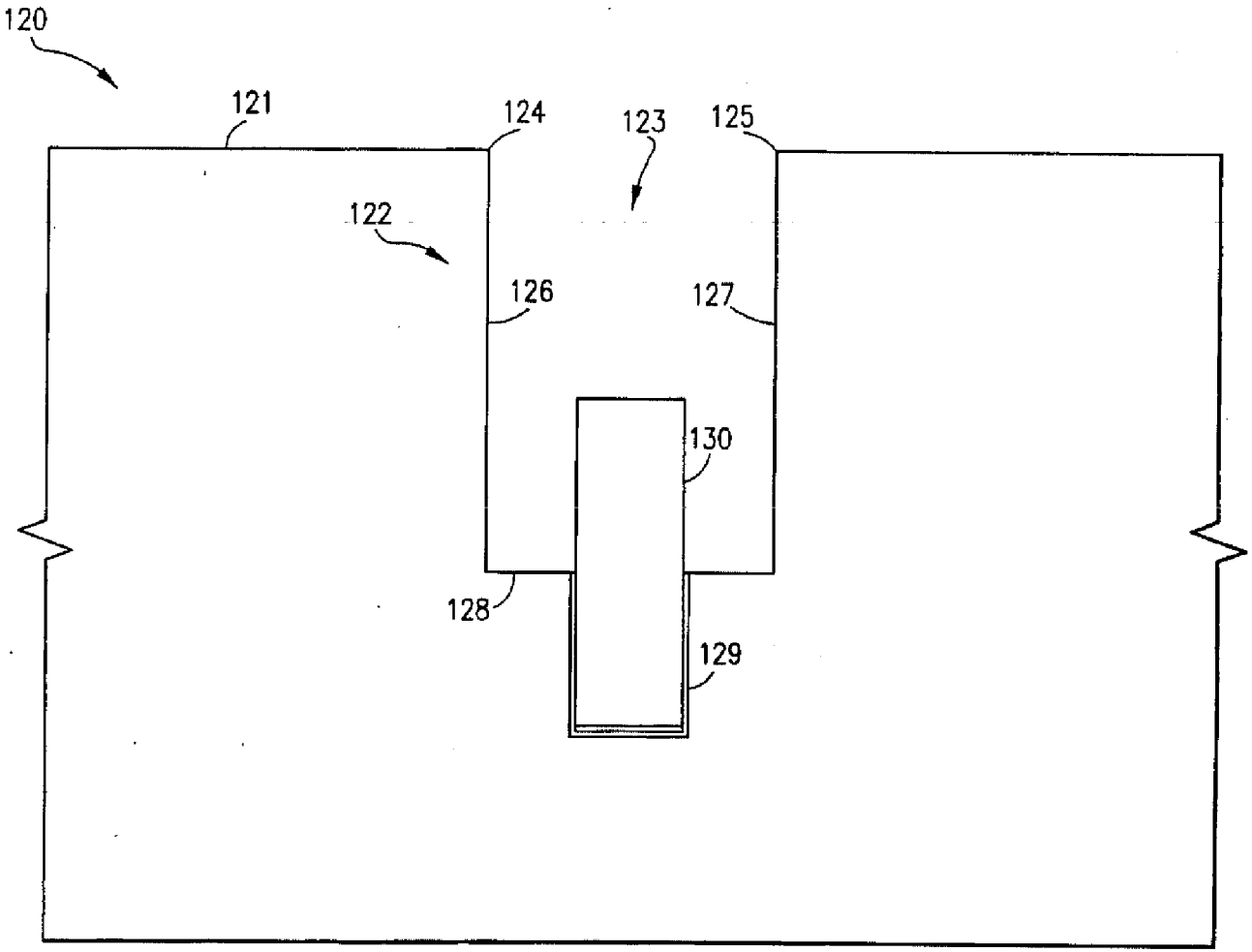

An alternate embodiment of the present invention is shown in FIGS. 6 and 7. The alternate embodiment is essentially the same as the preferred embodiment with the exception of the channel geometry. Deck structure 120 has a deck surface 121 and a channel 122 extending beneath deck surface 121. Channel 122 comprises a trough 123 having a generally U-shape cross section with a first end 124 and second end 125 proximate deck surface 121. Trough 123 further comprises a first member 126 extending from first end 124 generally perpendicular to deck surface 121 and a second member 127 extending from second end 125 and also generally perpendicular to deck surface 121 such that first member 126 and second member 127 are generally parallel. Extending between first member 126 and second member 127 is a third member 128. Depending on particular drainage requirements, third member 128 can be curved as shown in FIG. 6 or can be generally parallel to deck surface 121 and perpendicular to first member 126 and second member 127 as shown in a further alternate embodiment in FIG. 7. In addition, channel 122 contains a plurality of first holes 129 extending beneath deck structure 120 in a direction perpendicular to deck surface 121 and a plurality of inserts 130 fixed within first holes 129. All other features of the alternate embodiment are identical to those of the preferred embodiment and therefore will not be discussed any further. The alternate embodiments having different channel geometries to allow for different styles of drainage systems, which may be necessary depending on the pool deck structure, amount of water to drain, and style of pool safety fence pole to support.

While the invention has been described in what is known as presently the preferred embodiment, it is to be understood that the invention is not to be limited to the disclosed embodiment but, on the contrary, is intended to cover various modifications and equivalent arrangements within the scope of the following claims.

I claim:

1. A deck structure about a swimming pool having a deck surface and a channel extending beneath said deck surface, said channel containing a drainage device and a safety fence support system to be co-located, said channel comprising:

a trough having a generally elongated C-shape cross section, said generally elongated C-shape trough having a first end, a second end, and a generally curved body there between, with first and second sidewalls being generally parallel and extending from said first and second ends respectively to said deck surface, said first and second sidewalls generally perpendicular to said deck surface;

a plurality of first holes located in said generally curved body extending beneath said trough in a direction perpendicular to said deck surface; and, a plurality of inserts having an outer wall, inner wall, a thickness there between, a first length, and a second hole formed by said inner wall, said outer wall having dimensions such that said insert can be placed in said first hole of said elongated trough and said insert is sealed to said drainage device to prevent drainage water from leaking from said drainage device to said channel.

2. The deck structure of claim 1 wherein said first holes, said inserts, and said second hole in said insert are each generally circular in cross section.

3. The deck structure of claim 1 wherein said first holes, said inserts, and said second hole in said insert are each generally rectangular in cross section.

4. The deck structure of claim 1 wherein said drainage device further comprises a cover plate, said cover plate having a plurality of drainage apertures for communicating drainage water from said deck surface to said drainage device.

5. The deck structure of claim 1 wherein said inserts are manufactured from a polymer plastic composition.

6. The deck structure of claim 1 wherein said insert thickness is at least 0.030 inches and said insert extends from said first hole into said trough.

7. The deck structure of claim 1 wherein a safety pool fence pole can be inserted into said second hole of said insert.

8. The deck structure of claim 1 wherein a cover plug, having a second length, extends from said deck surface to proximate said first hole such that said second length of said cover plug is greater than said first length of said insert, where said cover plug is placed in said second hole of said insert when said insert is not supporting a safety fence pole.

9. A deck structure about a swimming pool having a deck surface and a channel extending beneath said deck surface, said channel and a safety fence support system to be co-located, said channel comprising:

a trough having a generally U-shape cross section, said generally U-shape trough having a first end, a second end, with first and second ends proximate said deck surface, a first member and a second member, said first member being generally parallel to said second member, said first and second members extending from said first and second ends and being generally perpendicular to said deck surface, a third member extending between said first and second members;

a plurality of first holes located in said third member extending beneath said trough in a direction perpendicular to said deck surface; and, a plurality of inserts having an outer wall, inner wall, a thickness there between, a length, and a second hole formed by said inner wall, said outer wall having dimensions such that said insert can be placed in said first hole of said trough and said insert is sealed to said drainage device to prevent drainage water from leaking from said drainage device to said channel.

10. The deck structure of claim 9 wherein said first holes, said inserts, and said second hole in said insert are each circular in cross section.

11. The deck structure of claim 9 wherein said first holes, said inserts, and said second hole in said insert are each generally rectangular in cross section.

12. The deck structure of claim 9 wherein said drainage device further comprises a cover plate, said cover plate having a plurality of drainage apertures for communicating drainage water from said deck surface to said drainage device.

13. The deck structure of claim 9 wherein said inserts are manufactured from a polymer plastic composition.

14. The deck structure of claim 9 wherein said insert thickness is at least 0.030 inches and said insert extends from said first hole into said trough.

15. The deck structure of claim 9 wherein a safety pool fence pole can be inserted into said second hole of said insert.

16. The deck structure of claim 9 wherein a cover plug, having a second length, extends from said deck surface to said first hole such that said second length of said cover plug is greater than said first length of said insert, where said cover plug is placed in said second hole of said insert when said insert is not supporting a safety fence pole.

* * * * *

UNITED STATES PATENT AND TRADEMARK OFFICE

CERTIFICATE OF CORRECTION

PATENT NO. : 6,810,631 B2
DATED : November 2, 2004
INVENTOR(S) : Robert J. Kraft It is certified that error appears in the above-identified patent and that said Letters Patent is hereby corrected as shown below:

Title page,
Item [74], *Attorney, Agent or Firm*, should read -- Mack, Brian R. --, not "Mack, Brian E."

Drawings,
Please replace old drawings with these new drawings that are attached.

Signed and Sealed this

Fourteenth Day of June, 2005

JON W. DUDAS
*Director of the United States Patent and Trademark Office*

(12) United States Patent
Kraft

(10) Patent No.: US 6,810,631 B2
(45) Date of Patent: Nov. 2, 2004

(54) POOL DECK DRAIN AND SAFETY FENCE SUPPORT STRUCTURE

(76) Inventor: Robert J. Kraft, 1470 SW. Dyer Point Rd., Palm City, FL (US) 34990

( * ) Notice: Subject to any disclaimer, the term of this patent is extended or adjusted under 35 U.S.C. 154(b) by 43 days.

(21) Appl. No.: 10/302,200

(22) Filed: Nov. 22, 2002

(65) Prior Publication Data

US 2004/0098936 A1 May 27, 2004

(51) Int. Cl.[7] ..... F02B 5/00

(52) U.S. Cl. ..... 52/298; 52/296; 52/302.3; 52/302.5

(58) Field of Search ..... 52/298, 296, 302.3, 52/302.5, 302.7, 16; 405/41, 119, 43

(56) References Cited

U.S. PATENT DOCUMENTS 2,210,441 A * 8/1940 Bachman ..... 52/297
4,490,067 A * 12/1984 Dubowski ..... 404/4
4,815,888 A 3/1989 Stegmeier
5,090,165 A * 2/1992 Kenny ..... 52/165
5,161,784 A * 11/1992 Sader ..... 256/24
5,340,234 A * 8/1994 Rossi et al. ..... 405/48
5,529,436 A * 6/1996 Meyers ..... 405/119
5,553,833 A 9/1996 Bohen
5,664,769 A 9/1997 Sadinsky et al.
6,123,321 A 9/2000 Miller
6,125,593 A * 10/2000 Randolph et al. ..... 52/16
6,612,780 B2 * 9/2003 Dubowski et al. ..... 405/118

* cited by examiner

*Primary Examiner*—Carl D. Friedman
*Assistant Examiner*—Basil Katcheves
(74) *Attorney, Agent, or Firm*—Brian E. Mack

(57) ABSTRACT

A novel pool deck structure channel located beneath a swimming pool deck surface is disclosed that incorporates both a drainage device and a pool safety fence support structure. The unique channel design eliminate the need to have separate support holes drilled in a pool deck surface that can be a safety hazard when not in use, cause functional problems due to dirt and debris, and are not otherwise aesthetically pleasing. The unique channel design includes an elongated trough extending beneath the pool deck surface for supporting a drainage device, a plurality of holes in the trough, and a plurality of inserts within the holes that extend into the trough in order to support pool safety fence support posts.

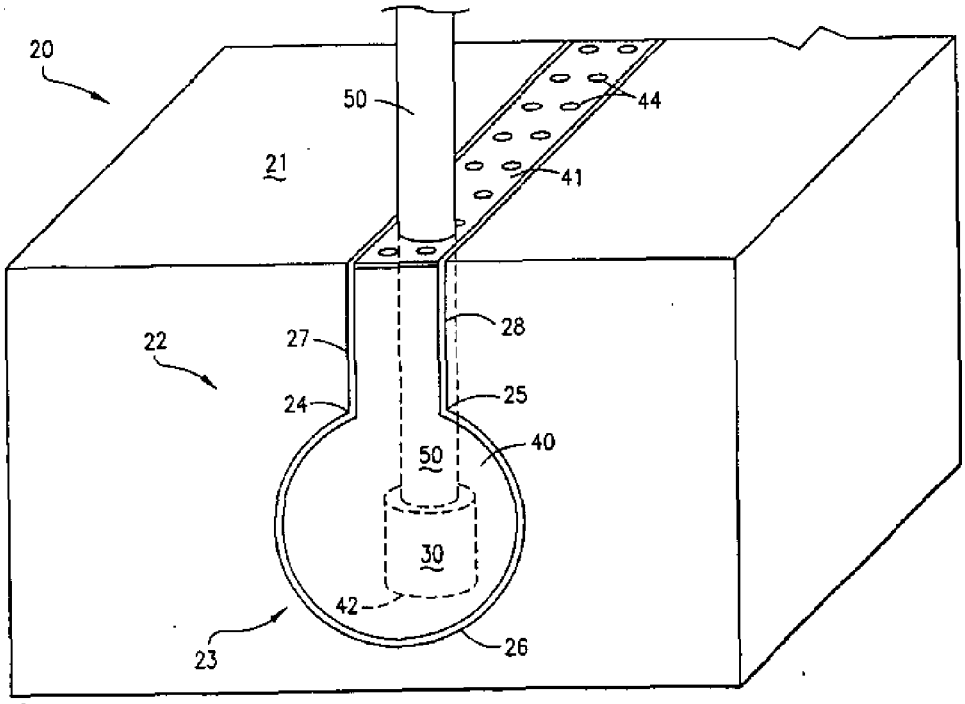

16 Claims, 7 Drawing Sheets